United States Patent [101]

Hofsaess

[11] 4,052,864

[45] Oct. 11, 1977

[54] MOBILE JEWELRY MOUNTING MOVED BY UNBALANCED MAGNETIC MEMBER

[76] Inventor: Werner K. Hofsaess, 2903 Palmer Drive, Los Angeles, Calif. 90065

[21] Appl. No.: 725,863

[22] Filed: Sept. 23, 1976

[51] Int. Cl.[2] ..... A44C 17/02

[52] U.S. Cl. ..... 63/31; 40/51; 40/106.45; 46/239; 63/29 M

[58] Field of Search ..... 63/31, 29 M; 40/51, 40/106.45; 46/236, 238, 239; 235/95 C

[56] References Cited

U.S. PATENT DOCUMENTS

| | | | |
|---|---|---|---|
| 546,171 | 9/1895 | Mantel | 40/106.45 X |
| 1,845,137 | 2/1932 | Disser | 40/51 |
| 2,323,837 | 7/1943 | Neal | 40/106.45 X |
| 3,908,307 | 9/1975 | Jacobson | 46/238 |
| 4,012,038 | 3/1977 | Brotz | 40/106.45 X |

FOREIGN PATENT DOCUMENTS

| | | | |
|---|---|---|---|
| 1,001,303 | 8/1965 | United Kingdom | 63/31 |
| 1,278,328 | 6/1972 | United Kingdom | 63/31 |

*Primary Examiner*—F. Barry Shay
*Attorney, Agent, or Firm*—Francis X. LoJacono, Sr.

[57] ABSTRACT

A mechanism operative to allow various jewelry settings mounted to a ring, bracelet, or locket to freely rotate in an oscillating manner about a fixed center point. The mechanism includes a mounting base member having a perpendicular mounting stem affixed thereto arranged to rotatably support a pendulum member having at least one pair of oppositely disposed magnets radially mounted thereto for rotation about the stem within the base member. Superposed above the pendulum and freely rotatable about the mounting stem is a platform to which various jewelry settings are mounted, the platform also including a pair of magnets which are radially aligned with the magnets of the pendulum so as to be rotatably activated by the movement of the pendulum, wherein the identical magnetic pole of each pair of magnets is juxtaposed, one above the other, causing a repulsing rotational action therebetween.

10 Claims, 6 Drawing Figures

FIG. 1.
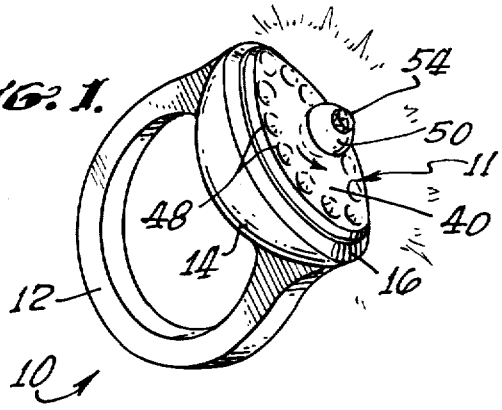
FIG. 5.
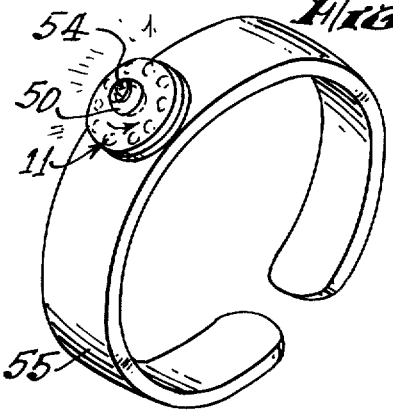
FIG. 6.
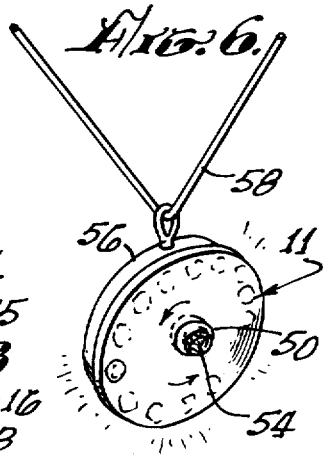
FIG. 2.
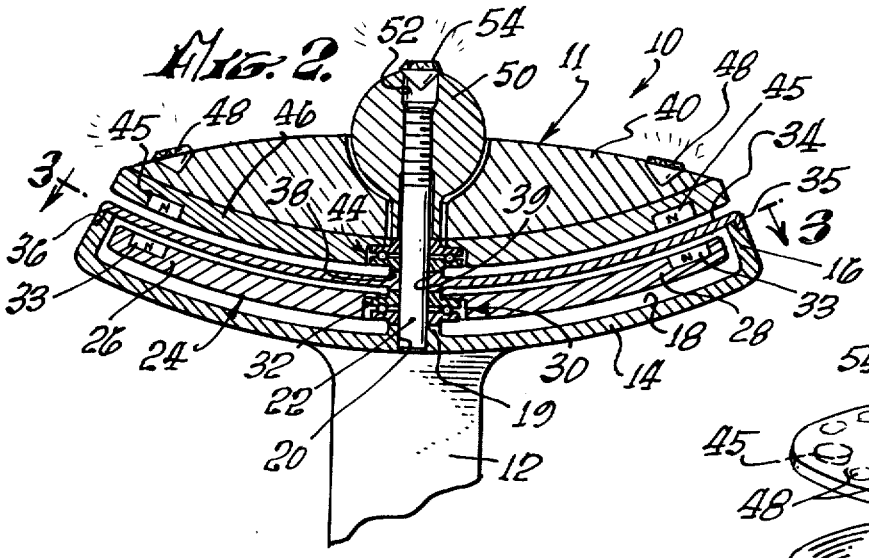
FIG. 3.
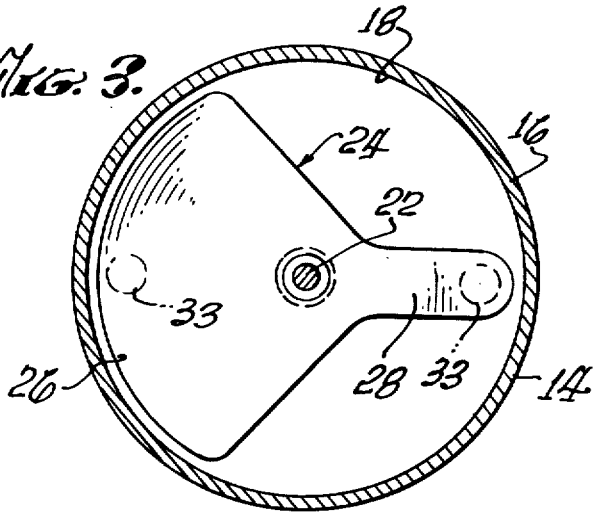
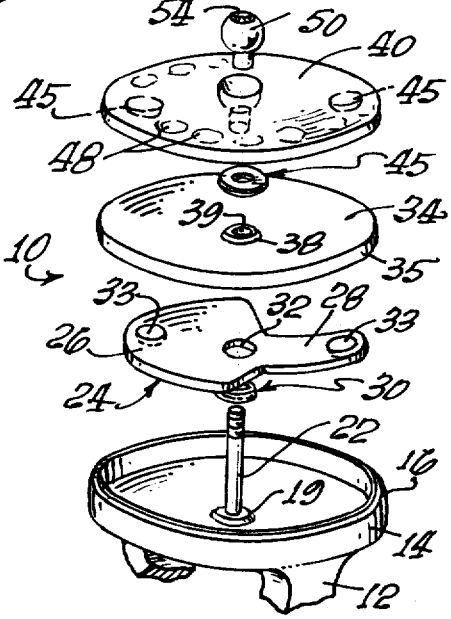
FIG. 4.

MOBILE JEWELRY MOUNTING MOVED BY UNBALANCED MAGNETIC MEMBER

BACKGROUND OF THE INVENTION

1. Field of the Invention

This invention relates to jewelry and the like such as rings, bracelets, lockets, etc., having various types of settings arranged thereon and, more particularly, to a mechanism incorporated with any of the above that provides motion to the attached settings.

2. Description of the Prior Art

It is well known in the art of jewelry that the gem settings are mounted to rings, bracelets and the like in a stationary manner. At present, there is no mechanism that provides an artisic, ornamental movement for jewelry settings to allow a unique mobile display for any particular piece of jewelry.

OBJECTS AND ADVANTAGES OF THE INVENTION

The present invention has for an important object a provision wherein jewelry settings can become mobile, creating an ornamental display heretofore not possible.

It is another object of the invention to provide a mobile jewelry mounting mechanism that is capable of being incorporated in all types of mounting devices, such as rings, bracelets, necklaces and lockets.

It is still another object of the invention to provide a mobile jewelry mounting mechanism that allows the setting to oscillate about a given point in a rotational manner upon the slightest movement of the wearer thereof.

A further object of the invention is to provide a mobile jewelry mounting mechanism that incorporates the magnetic fields of force to generate an unpredictable type of movement of the jewelry setting, wherein the setting oscillates within a stationary mounting—be it a ring, bracelet, etc..

It is a further object of the present invention to provide a mobile jewelry mounting mechanism that includes a pendulum having a pair of identical magnetic fields disposed thereon, to correspond to a second pair of identical magnetic fields disposed within the movable mounting means which includes the jewelry setting thereof.

It is still a further object of the invention to provide a mechanism of this character that includes relatively few operating parts.

Another object of the invention is to provide a mechanism of this character that is easy to service and maintain.

Still another object of the invention is to provide a mechanism of this character that is relatively inexpensive to manufacture.

The characteristics and advantages of the invention are further sufficiently referred to in connection with the accomanying drawings, which represent one embodiment. After considering this example, skilled persons will understand that variations may be made without departing from the principles disclosed and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of the present invention incorporated in a ring;

FIG. 2 is an enlarged cross-sectional view of the mobile jewelry mounting mechanism;

FIG. 3 is a cross-sectional view taken substantially along line 3—3 of FIG. 2, wherein the pendulum is illustrated having a pair of oppositely disposed magnets;

FIG. 4 is an exploded perspective view showing the present invention thereof;

FIG. 5 is another example of how the mobile jewelry mounting mechanism is mounted to a bracelet; and FIG. 6 illustrates the present invention used as a locket on a neck chain.

DESCRIPTION OF THE PREFERRED EMBODIMENT

Referring more particularly to FIGS. 1,2,3 and 4, there is illustrated a piece of jewelry which is represented by a ring, generally indicated at 10, having the present mechanism 11 mounted thereto. The ring 10 includes a ringlet 12 having a mounting base 14 integrally formed therewith. Said mounting base can be of any suitable configuration; but it is best when formed in a circular manner as herein shown. An annular upturned flange member 16 defines a compartment 18, wherein a central boss 19 is provided having therein a central bore 20 disposed therein and adapted to receive a mounting stem 22. The stem 22 is fixed within bore 20 in a perpendicular arrangement to the base member 14, wherein an unbalanced rotatable means is mounted on said stem by bearing means. The unbalanced rotatable means is formed as a pendulum member, generally indicated at 24, having an enlarged head member 26 and a narrow elongated neck member 28, each member 26 and 28 being positioned opposite to the other. Thus, when the ring 10 is worn on the hand of an individual, any movement thereof will cause the pendulum to rotate, whereby head 26 will always seek to hang downwardly. However, it should be noted that most movements will cause enough kinetic energy to allow several revolutions of the pendulum to occur; yet some type of movements will cause only an oscillating action to take place.

To provide ease of rotation of pendulum 24, there is included a bearing means 30 interdisposed between the pendulum 24 and boss 19, the bearing being secured in a recess 32 formed in pendulum 24.

Magnetic means are included within the pendulum 24 and are shown as a pair of small magnets 33, one being oppositely positioned to the other; that is, one is affixed to head 26 adjacent the edge thereof, and the other magnet is affixed to the terminating end of neck member 28 so as to rotate about stem 22 with said pendulum 24.

After the pendulum is placed within compartment 18 as shown in FIGS. 2 and 3, a protective cover 34 is mounted over said compartment wherein an annular lip 35 is received in a matching annular recess 36 formed in circular flange 16. Centrally formed in cover 34 is a boss 38 which includes hole 39 to receive stem 22 therethrough, so as to allow a rotatable reacting means to be supported thereon. The rotatable reacting means comprises a platform 40 having a generally circular shape with a diameter approxiamtely equal to that of the base 14 and cover 34, as seen in FIG. 2. Platform 40 includes a recess 42 in which bearing means 44 is located so as to be supported on boss 38 of cover 34; and a second pair of matching magnets 45 are aligned annularly with respective matching magnets 34 juxtapositioned below the second pair 45.

It is important to note that the pole of each magnet 45 is identical to each magnet 34; and, for best reacting results, the negative pole is used for each magnet. Accordingly, as the upper magnets 45 are positioned directly over the lower magnets 34, they are each in themselves repelled by the respective oppositely arranged magnet—and thus cause platform 40 to move thereby, rotating about stem 22.

Various assemblies and configurations are contemplated for platform 40, wherein it can be made as an integral member including a mounting member for the jewelry setting; or, as shown in FIG. 2, wherein the mounting member for the jewelry setting 46 is a separate part thereof. Thus, various mountings for settings can be affixed to platform 40 with unlimited variations as to design with the use of gems 48.

To hold the platform 40 and mounting in a rotatable arrangement, stem 22 is provided with a threaded free end to which a nut 50 is secured. The nut 50 can be of any suitable material and shape having a threaded bore 51 and an enlarged bore 52 to receive a gemstone 54 therein.

As previously mentioned, the pendulum will constantly revolve about stem 22 when a ring is worn; if the mechanism 11 is attached to a bracelet 55 as seen in FIG. 5; or supported as a locket 56 an chain 58. Due to the configuration of the pendulum together with the action of the magnetic forces, the stem can be displaced at any angle, vertically or horizontally, and still provide a rotational movement.

In addition, it should also be noted that each element—base 14, pendulum 24, cover 35, and platform 40—can be provided with flat or disc-shaped configurations, as herein disclosed.

The invention and its attendant advantages will be understood from the foregoing description and it will be apparent that various changes may be made in the from, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A mobile jewelry mounting mechanism comprising:

a mounting base member;

an unbalanced rotatable member supported on said base member in freely rotatable relation thereto;

a first magnetic means arranged within said unbalanced rotatable member to rotate therewith;

a jewelry-setting support means rotatably mounted on said base member and superposed over said unbalanced rotatable member;

a second magnetic means arranged within said jewelry-setting support means wherein said first and second magnetic means provide corresponding repelling forces to each other; and means for securing said unbalanced rotatable member and said jewelry-setting support means in relatively rotatable relation to one another, and in a relation whereby movements of said unbalanced rotatable member are transmitted to said jewelry-setting support means by interaction of said first and second magnetic means.

2. A mobile jewelry mounting mechanism as recited in claim 1, wherein said base member includes a compartment having a cover mounted thereover disposed between said unbalanced rotatable member and said jewelry-setting support means.

3. A mobile jewelry mounting mechanism as recited in claim 2, wherein said means for securing includes:

a first bearing being means mounted to said unbalanced rotatable member; and a second bearing means mounted to said jewelry-setting support means, whereby said unbalanced rotatable member and said jewelry-setting support means rotate independently of each other.

4. A mobile jewelry mounting mechanism as recited in claim 3, wherein said unbalanced rotatable member comprises a pendulum having an enlarged head member and an oppositely disposed neck member, thereby cuasing rotational movement of said pendulum when said mechanism is displaced.

5. A mobile jewelry mounting mechanism as recited in claim 4, wherein said jewelry-setting support means comprises a support platform.

6. A mobile jewelry mounting mechanism as recited in claim 5, wherein said means for rotatably securing said unbalanced rotatable member and said jewelry-setting support means further comprises:

a stem mounted perpendicularly in the center of said base member, whereby said pendulum and said platform are rotatably supported thereon, said stem having a threaded free end; and a nut threadably attached to said free end of said stem.

7. A mobile jewelry mounting mechanism as recited in claim 6, wherein said first magnetic means comprises a pair of magnets, one being positioned in said head member of said pendulum, the other being positioned in said neck member thereof, and wherein said second magnetic means comprises a pair of magnets, each magnet thereof being positioned on opposite sides of said platform so as to align with each corresponding magnet of said pendulum, whereby rotational movement of said pendulum will cause a responsive reaction to said platform.

8. A mobile jewelry mounting mechanism as recited in claim 7, wherein said jewelry-setting support means includes a jewelry setting mount member secured to said platform, whereby various ornamental jewelry-display pieces are mounted thereto for rotation with said platform.

9. A mobile jewelry mounting mechanism as recited in claim 7, wherein said platform, said cover, and said base are formed having concave-convex configuration.

10. A mobile jewelry mounting mechanism as recited in claim 8, wherein said first and second pair of magnets are arranged having the negative poles thereof oppositely facing each other to provide a repulsing action therebetween.

* * * * *